United States Patent [19]

Wertz et al.

[11] Patent Number: 4,620,642

[45] Date of Patent: Nov. 4, 1986

[54] RESILIENT PLUG CLOSURE

[76] Inventors: Keith J. Wertz, 2533 S. Deegan Dr., Santa Ana, Calif. 92704; Emmett Graham, 9101 N. 60th St., Paradise Valley, Ariz. 85253

[21] Appl. No.: 714,004

[22] Filed: Mar. 20, 1984

[51] Int. Cl.[4] ..... B65D 39/00

[52] U.S. Cl. ..... 220/307; 220/377

[58] Field of Search ..... 220/307, DIG. 19, 377, 220/354, 355, 356

[56] References Cited

U.S. PATENT DOCUMENTS

| | | | |
|---|---|---|---|
| 3,469,735 | 9/1969 | Burt | 220/90 |
| 3,510,023 | 8/1968 | Ullman | 220/60 |
| 3,913,785 | 10/1975 | Pattershall | 220/354 |
| 4,240,568 | 12/1980 | Pool | 222/189 |
| 4,266,689 | 5/1981 | Asher | 220/307 |
| 4,312,459 | 1/1982 | Leach | 220/256 |
| 4,446,986 | 5/1984 | Bowen | 220/307 |

*Primary Examiner*—George T. Hall

*Attorney, Agent, or Firm*—Price, Gess & Ubell

[57] ABSTRACT

A fluid container lid is disclosed which includes an outer rim and a curved sealing collar coupled to the inner portion of the top rim and extending downwardly therefrom. The fluid container lid further includes an outwardly extending annular locking shoulder which is coupled to the bottom of the sealing collar. The annular shoulder includes an outwardly extending top surface which is coupled to an inwardly extending lower surface. A lid bottom is coupled to the inwardly extending lower surface. The sealing collar and the locking shoulder are adapted to engage the inside of the rim of a fluid container. The top rim of the lid further includes an outwardly extending tab for facilitating the removal of the lid from the container.

11 Claims, 4 Drawing Figures

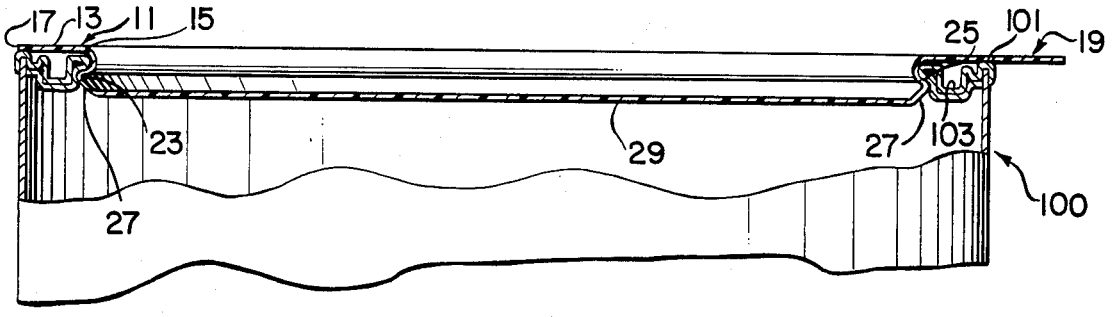
FIG. 4
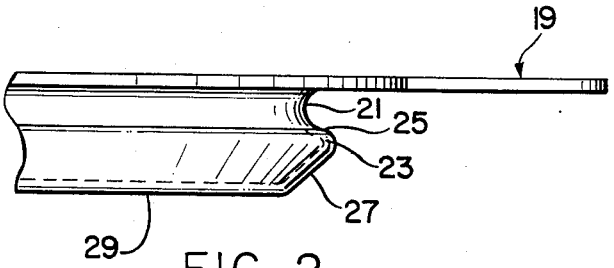
FIG. 2
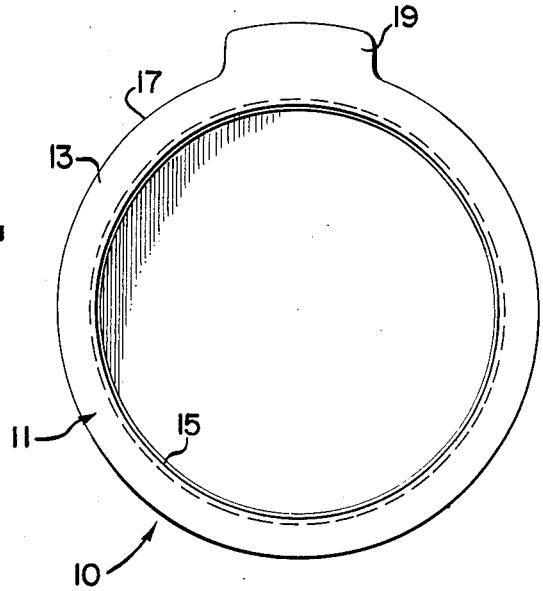
FIG. 3
FIG. 1
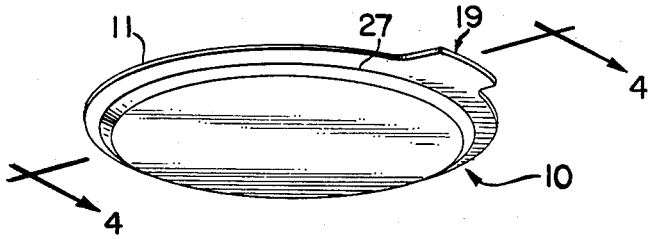

RESILIENT PLUG CLOSURE

BACKGROUND OF THE INVENTION

The disclosed invention is directed to a fluid container lid, and is particularly directed to an improved fluid container lid which securely snaps onto a paint can or the like and is removed without tools.

Paint and other fluids are commonly contained within a resealable cylindrical metallic can which includes an annular rim at the top of the can adjacent the can opening. An annular sealing groove is formed in the annular rim for receiving the mating flange of a suitable lid.

In use, the fluid contained within the resealable can is typically dispensed by pouring the fluid directly from the can or by means of a brush which is dipped into the fluid and wiped on the annular rim to remove excess fluid. With either practice, the annular sealing groove fills with fluid.

The accumulated fluid in the sealing groove must be removed from the sealing groove prior to resealing. Besides being tedious, efforts at fluid removal do not always result in complete removal, particularly with fluids like paint.

There have been numerous purported solutions to the problems posed by the sealing grooves in cans. Some purported solutions have been directed to avoiding spillage into the grooves, while others have been directed to resealable containers without sealing grooves.

U.S. Pat. No. 4,240,568 discloses an attachment for a liquid carrying container. The attachment includes an annular ledge which sealingly engages over the annular sealing groove of the container. The ledge has an upstanding outer peripheral rim which redirects fluid into the container. A closure member is hingedly affixed to the body member and sealingly engages the body member for airtight storage of the liquid. In one embodiment, the body member is secured to the container by engaging against the inner periphery of the rim structure of the container.

U.S. Pat. No. 3,469,735 discloses a protector and resealer device for paint cans. The device comprises a ring of relatively rigid plastic material which clips to the top of the can when the lid is removed to cover the sealing groove, yet leaves the open mouth of the can unobstructed. The ring serves to prevent accumulation of paint in the sealing groove.

U.S. Pat. No. 3,913,785 discloses a sealing groove cover for a paint container. The cover comprises an annular band of plastic material for positioning on the upper end of the container when the lid is removed to provide a cover for the lid sealing groove which surrounds the container opening.

U.S. Pat. No. 4,312,459 discloses a paint can rim cover and lid combination, including an annular rim cover of flexible material and having a channel-shaped cross section of a width approximating that of the rim. The rim cover snaps over the inner and outer periphery of the rim to seal the rim. A lid of flexible material is provided with a circular panel section and a depending peripheral flange so that the lid may be fitted on the rim cover with the flange overlapping the rim cover for releasably locking the lid to the rim cover.

U.S. Pat. No. 4,446,986 discloses a fluid tight container and closure assembly fabricated from plastic material. The container comprises a sidewall member extending upwardly to a rim which forms the container opening. The inside of the sidewall near the rim defines a downwardly and inwardly extending abutment surface terminating at an annular notch. The closure has a circular cover portion connected at its periphery to a U-shaped annular rim defining an inner wall and a radially spaced outer wall. The outer wall defines an annular shoulder and abutment surface, which terminates at an angular annular flange attached to the upper end of the outer wall. In assembling the container and closure member, the U-shaped rim fits within the inner side of the sidewall of the container so that the shoulder formed in the outer wall of the closure member snaps into place over and locks with the notch formed on the inner side of the sidewall. The abutment surfaces of the sidewall and closure member are in sealing contact with each other.

U.S. Pat. No. 3,510,023 discloses a plastic container and lid assembly. The lid includes an annular channel at its outer periphery adapted to fit over the rim of the plastic container in sealing engagement.

Some of the known devices are complex and interface with the dispensing of fluid from the container. Other known devices avoid the use of standard containers, thereby requiring increased costs in their use. Still other devices cooperate with the sealing grooves and therefore cannot be used with containers without sealing grooves.

SUMMARY OF THE INVENTION

It is therefore an object of the invention to provide an improved lid for fluid containers having sealing grooves.

It is also an object of the invention to provide a lid for fluid containers with sealing grooves, wherein such lid covers the sealing grooves.

Another object of the invention is to provide a lid for resealable fluid containers, wherein such lid does not require a sealing groove.

Still another object of the invention is to provide a lid for resealable fluid containers which securely seals and can be removed without the use of tools.

A further object of the invention is to provide a lid for fluid containers having a sealing groove, wherein the lid is efficiently and inexpensively manufactured.

It is also an object of the invention to provide a lid for fluid containers which is transparent or transluscent.

The foregoing and other objects of the invention are achieved in a container lid having an outer top rim and a curved sealing collar coupled to the inner portion of the top rim and extending downwardly therefrom. An outwardly extending annular locking shoulder is coupled to the bottom of the sealing collar and includes an inwardly extending lower surface. A lid bottom is coupled to the lower surface of the locking shoulder. The curved sealing collar and the annular locking shoulder are adapted to engage the inside of the rim of a fluid container. The outer rim of the lid further includes an outwardly extending tab for facilitating the removal of the lid from the container.

BRIEF DESCRIPTION OF THE DRAWING

The advantages and features of the disclosed invention will readily be appreciated by persons skilled in the art from the following detailed description when read in conjunction with the drawing wherein:

FIG. 1 is a perspective view of the container lid of the invention.

FIG. 2 is a partial side elevation view of the container lid of FIG. 1.

FIG. 3 is a top plan view of the container lid of FIG. 1.

FIG. 4 is a cross-sectional view taken along the line 4—4 of FIG. 1.

DETAILED DESCRIPTION

In the following detailed description and in the several figures of the drawing, like elements are identified with like reference numerals.

Referring now to the figures of the drawing, shown therein are views of the disclosed container lid 10 which includes an outer rim 11 having a planar top surface 13 and a circular inner edge 15. The outer rim 11 includes a partially circular outer edge 17 and an outwardly radially extending tab portion 19. The tab portion 19 facilitates removal of the lid 10 from a fluid container.

An annular sealing collar 21 is substantially tangentially coupled to the inner edge 15 of the outer rim 11 and extends downwardly therefrom. As particularly shown in FIG. 4, the sealing collar 21 is inwardly curved in cross section to provide a sinusoid sealing surface.

An annular locking shoulder 23 is coupled to the bottom of the sealing collar 21. The annular locking shoulder 23 includes a curved top surface 25 which extends outwardly radially and further includes an angled or conical bottom surface 27 which extends inwardly and downwardly. A planar lid bottom 29 is coupled to the terminal portion of the bottom surface 27 of the locking shoulder 23 and lies in a plane parallel to the plane of the planar top surface 13.

The container lid 10 is intended to be utilized with a fluid container such as a cylindrical paint can 100 having an inwardly extending top rim 101 a rolled inner edge, as shown in FIG. 4. While the container rim 101 is shown as including a sealing groove 103, it should be readily apparent that the lid 10 does not utilize the sealing groove 103 to seal the fluid container 100.

The sealing collar 21 is dimensioned to fit the inside of the rim 101 of the fluid container 100. Thus, the outer perimeter of the locking shoulder 23 is slightly larger than the perimeter of the opening defined by the rim 101 of the fluid container 100.

In use, the lid 10 is pressed into the opening of the fluid container 100 so that the tapered surface 25 continuously engages the top inside edge of the rim 101 of the container 100. Further pressure will force the locking shoulder 23 past the inner surface of the rim 101 of the container 100 so that the top surface 25 of the locking shoulder 23 snaps in and engages the bottom inner edge of the rim 101 of the container 100. The sealing collar 21 and the top surface 25 of the locking shoulder 23 form a seal against inside surfaces of the rim 101 of the container 100.

When the lid 10 is installed in the opening of a fluid container having a sealing groove, such as the container 100 shown in FIG. 4, the outer rim 11 covers the sealing groove, thereby preventing splashes or drips of fluid from the sealing groove.

Since the above described container lid 10 does not require a container rim having a sealing groove, it can function with fluid containers that do not have sealing grooves. The container lid 10 merely requires a container having a rim defining the container opening and which has inside surfaces that can be engaged by the annular sealing collar 21 and the top surface 25 of the annular locking shoulder 23.

By way of example, the container lid 10 is preferrably made of plastic material as a unitary structure, and therefore may be made by known techniques such as injection molding or vacuum forming. Also by way of example, the container lid 10 may be wholly or partially transparent or transluscent, which would be particularly useful for paints so that color could be readily determined or verified.

The foregoing has been a description of a particularly advantageous fluid container lid which is simple, effective, and relatively inexpensive to manufacture. Further, the disclosed fluid container lid does not require special containers, nor does it interfere with the dispensing of fluid from the container with which it is used.

Although the foregoing has been a description and illustration of specific embodiments of the invention, various modifications and changes thereto can be made by persons skilled in the art without departing from the scope and spirit of the invention as defined by the following claims.

What is claimed is:

1. A reusable lid for a paint can container having a grooved top rim comprising:

a planar outer rim of a size to extend across and to close the grooved rim of the paint can container, spaced radially inward from the outer rim is a recessed substantially circular inner edge;

annular sealing means extending downwardly from said circular inner edge for engaging the inside of the top rim of the container includes a substantially cross-sectional sinusoid outer radial configuration for providing a continuous sealing surface with the inside of the top rim of the container; and a planar bottom portion connected to the annular sealing means, the planar outer rim lying in a plane substantially tangential to the curved end of the sinusoid sealing configuration whereby any paint that accumulates in the grooved top rim of the paint can container will not be displaced and splattered by the sealing of the paint can container with the reusable lid.

2. The lid of claim 1 wherein said planar outer rim further includes a pull tab.

3. The lid of claim 1 wherein said locking means comprises an annular shoulder having an outwardly extending top surface and an inwardly extending bottom surface.

4. The lid of claim 1 wherein said planar outer rim, said annular sealing means, and said planar bottom portion comprise a unitary structure made of plastic material.

5. The lid of claim 1 wherein said planar outer rim, said annular sealing means, and said planar bottom portion comprise a unitary structure which is at least partially transparent or transluscent.

6. The lid of claim 1 further including a conical portion interconnecting the sealing means with the planar bottom portion.

7. A plastic removable flexible paint can lid for replacing the metal lid on a cylindrical paint can having a grooved top rim with a rolled inner edge, comprising:

an upper planar annular rim lying in a first plane and having a diameter of approximately the diameter of the exterior cylindrical surface of the paint can;

a bottom planar portion lying in a second plane parallel to the first plane; and a sinusoid sealing surface substantially cross-sectionally defined between the upper planar annular rim and the bottom planar portion for providing a continuous sealing contact with the rolled inner edge, the planar annular outer rim is substantially tangential to the upper sealing surface and extends radially outward to cover the grooved top rim of the paint can whereby any paint that accumulates in the grooved top rim during use will not be splattered by the sealing of the flexible paint can lid.

8. The invention of claim 7 wherein the bottom planar portion is connected to the sealing surface by an annular conical portion having an increasing diameter from the bottom planar portion to the sealing surface.

9. The invention of claim 8 wherein the annular rim further includes a tab portion that extends radially outward from the annular rim.

10. The invention of claim 9 wherein the plastic paint can lid is sufficiently transparent to permit a determination of the color of the paint in the paint can.

11. A unitary one piece plastic removable flexible paint can lid for replacing the metal lid on a cylindrical paint can having a grooved top rim with a rolled inner edge, comprising:

an upper planar annular rim lying in a first plane and having a diameter of approximately the diameter of the exterior cylindrical surface of the paint can;

a bottom planar portion lying in a second plane parallel to the first plane and being sufficiently transparent to permit a determination of the color of the paint in the paint can;

a sinusoid sealing surface is substantially cross-sectionally defined between the upper planar annular rim and the bottom planar portion for providing a complimentarily continous sealing contact surface with the entire rolled inner edge of the paint can, the planar annular outer rim is substantially tangential to the upper portion of the sealing surface and extends radially outward to cover the grooved top rim of the paint can; and an annular conical portion having an increasing diameter as it extends upward from the bottom planar portion to connect with the sealing surface whereby any paint that accumulates in the grooved top rim during use will not be splattered by the sealing of the flexible paint can lid.

* * * * *